US009580922B2

(12) United States Patent
Hagemes et al.

(10) Patent No.: US 9,580,922 B2
(45) Date of Patent: Feb. 28, 2017

(54) LOCKING DEVICE HAVING WALL FORMWORK LOCKING DEVICE AND PROCESS

(71) Applicant: Hünnebeck GmbH, Ratingen (DE)

(72) Inventors: Klaus Hagemes, Viersen (DE); Volker Klehr, Viersen (DE)

(73) Assignee: Hünnebeck GmbH, Ratingen (DE)

( * ) Notice: Subject to any disclaimer, the term of this patent is extended or adjusted under 35 U.S.C. 154(b) by 0 days.

(21) Appl. No.: 14/415,595

(22) PCT Filed: Jul. 12, 2013

(86) PCT No.: PCT/EP2013/064761

§ 371 (c)(1),
(2) Date: Jan. 18, 2015

(87) PCT Pub. No.: WO2014/012853

PCT Pub. Date: Jan. 23, 2014

(65) Prior Publication Data

US 2015/0167329 A1 Jun. 18, 2015

(30) Foreign Application Priority Data

Jul. 18, 2012 (DE) ..... 10 2012 212 603

(51) Int. Cl.
*E04G 17/065* (2006.01)
*E04B 2/84* (2006.01)
*E04G 11/08* (2006.01)

(52) U.S. Cl.
CPC ..... *E04G 17/0657* (2013.01); *E04B 2/84* (2013.01); *E04G 11/08* (2013.01); *E04G 17/0652* (2013.01)

(58) Field of Classification Search
CPC ..... E04G 17/0652; E04G 17/0657; E04G 17/0721; E04G 1/21; E04C 5/122; E04C 5/12; E04C 5/125; E04C 5/127
(Continued)

(56) References Cited

U.S. PATENT DOCUMENTS 3,357,672 A * 12/1967 Capek ..... 249/45
3,896,599 A * 7/1975 Werstein et al. ..... 52/704
(Continued)

FOREIGN PATENT DOCUMENTS

DE 4207749 C1 4/1993
GB 781052 A 8/1957
WO WO-2008/089737 A1 7/2008

OTHER PUBLICATIONS

International Search Report mailed Oct. 10, 2013; Authorized Officer: Andlauer, Dominique.

*Primary Examiner* — Patrick Maestri
(74) *Attorney, Agent, or Firm* — Winstead PC

(57) ABSTRACT

The invention relates to a locking device for an anchor rod which may be mounted to a wall formwork. Moreover the invention relates to an associated wall formwork as well as process for mounting the locking device to the wall formwork. Moreover the invention relates to a system having a locking device and wall formwork. A locking device having a locking means for mounting the locking device to one end of an anchor rod and a mounting device for mounting the locking device to a wall formwork is provided. The mounting device comprises a screw which is tilted such that it may be secured in a hole of a supporting element of a wall formwork. A wall formwork thus advantageously does not require a thread in order to be able to mount the locking device to a wall formwork.

15 Claims, 3 Drawing Sheets

(58) Field of Classification Search
USPC ..... 52/223.13, 698–701, 703–711
See application file for complete search history.

(56) References Cited

U.S. PATENT DOCUMENTS

| | | | | | |
|---|---|---|---|---|---|
| 4,553,729 | A * | 11/1985 | Connors | 249/40 |
| 4,719,658 | A * | 1/1988 | Kriofske | 52/223.13 |
| 4,899,978 | A * | 2/1990 | Gates | 249/219.2 |
| 5,079,879 | A * | 1/1992 | Rodriguez | 52/223.13 |
| 5,347,777 | A * | 9/1994 | Sudduth | 52/223.13 |
| 5,755,065 | A * | 5/1998 | Sorkin | 52/223.13 |
| 6,023,894 | A * | 2/2000 | Sorkin | 52/223.8 |
| 8,087,204 | B1 * | 1/2012 | Sorkin | 52/223.13 |
| 2007/0289239 | A1 * | 12/2007 | Lee et al. | 52/426 |
| 2009/0025332 | A1 * | 1/2009 | Richards | 52/704 |
| 2010/0059655 | A1 * | 3/2010 | Schwoerer | 249/18 |
| 2012/0117913 | A1 * | 5/2012 | Melic | 52/703 |
| 2012/0286134 | A1 * | 11/2012 | Rojas Pimienta | 249/192 |
| 2012/0304570 | A1 * | 12/2012 | Braun et al. | 52/426 |
| 2015/0167330 | A1 * | 6/2015 | Berger et al. | 52/703 |

* cited by examiner 1
2
3
4
5
6
7
8
9
10
11
12
13
14
15
16
17
18
19
20
21
27

LOCKING DEVICE HAVING WALL FORMWORK LOCKING DEVICE AND PROCESS

TECHNICAL FIELD

The invention relates to a locking device for an anchor rod, which may be mounted to a wall formwork. Moreover the invention relates to a wall formwork associated therewith, a system having a locking device and wall formwork as well as a process for mounting the locking device to the wall formwork.

BACKGROUND

In formwork technology difference is made between a first formwork and a closing formwork. A first formwork is a formwork which is mounted first. Subsequent to this the closing formwork is mounted opposite to the first formwork. Concrete is cast in the interstitial space between the first formwork and the closing formwork. By curing the concrete a wall is produced.

Generally one or both ends of an anchor rod have threads into which screw nuts are inserted as an anchor fixation. The central area of such an anchor rod to which, during concrete casting, concrete may be adjacent advantageously either has a smooth surface or at least will be encased by a bushing having a smooth surface. Otherwise the thread of an anchor rod would be set in concrete. The anchor rod then may not be easily pulled out of the cured concrete.

The maximum effective length of the anchor rod and hence the strength (thickness) of the wall to be concrete cast is regularly defined by the length of the central range of the anchor rod having a smooth surface. At the same time pressure exerted onto the formwork facing by liquid concrete during casting will be dissipated via the screw nuts. The anchor rods thereby will be tensile-strained.

Between the formwork facings spacers may be inserted into the volume of the wall to be cast which may absorb the compressive forces emerging during casting, thereby assuring these compressive forces not to affect the wall thickness in an undesirable manner, i.e. reducing the wall thickness. Alternatively or additionally the locking devices may also be mounted onto the wall formworks so that the latter may also be able to absorb compressive forces.

From the document WO 2008/089737 A1 an anchoring system having two locking devices and one anchor rod for a wall formwork having first and a second formwork elements is known. The anchor rod on each of its both ends has a thread which is inserted into the screw nut elements of the locking devices. Each locking device comprises a calotte plate which is mounted to a back side of a wall formwork by way of mounting means. The anchor system may hence absorb both tensile and compressive forces.

SUMMARY

The features mentioned above which are known from prior art may individually be combined or may be combined in any combination with the article according to the invention.

An anchoring system according to the present invention is used in formwork technology in the context of a concrete casting process of reinforced concrete constructions for mounting wall formworks. On the front side a wall formwork comprises a formwork facing and on the back side the formwork facing comprises supporting elements such as longitudinal beams, crossbars and frames. Both sides of a wall to be cast in concrete are encased by wall formworks. In this way the front side of each wall formwork is adjacent to the concrete. Generally opposite wall formworks are held by a multitude of anchoring systems. The anchor rods are passed through openings in the wall formworks and will be mounted at their ends to elements supporting the respective formwork facing such that at least the tensile force acting onto the anchor rods during concrete casting will be absorbed. In the following these openings passing through the wall formworks will be designated as anchor rod bore holes.

It is an object of the present invention to refine a locking device for an anchoring system together with a wall formwork.

The object of the invention will be solved by way of a locking device having the features of the main claim, a wall formwork having the features of the corresponding further independent claim, as well as a process having the features of the corresponding independent claim. Advantageous embodiments will arise from the subclaims.

DETAILED DESCRIPTION

Figures 1, 2:
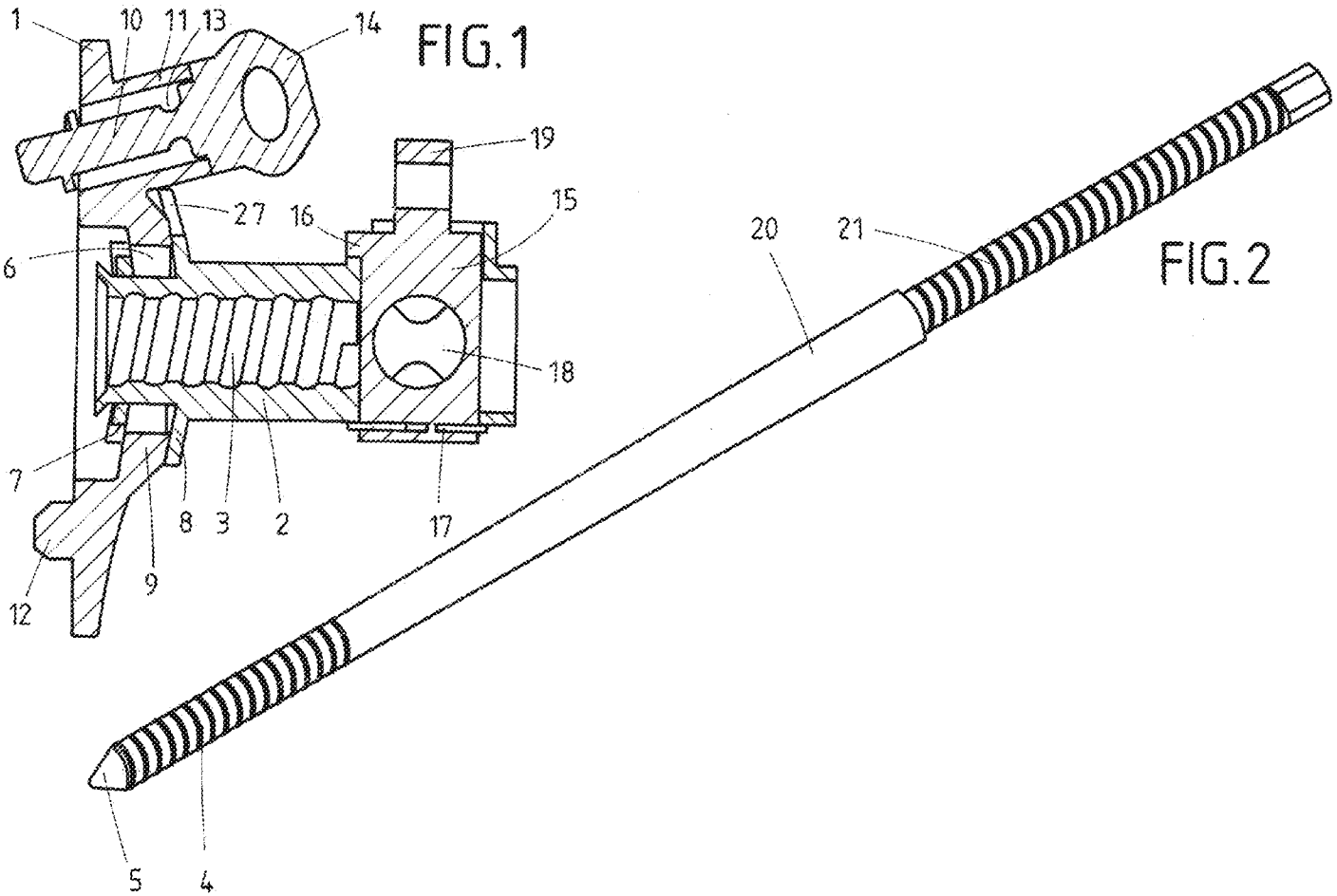
FIG. 1 is a sectional view of a locking device.
FIG. 2 is a perspective view of an anchor rod.

To solve the problem a locking device having mounting means for mounting the locking device to one end of the anchor rod and a mounting device for mounting the locking device to a wall formwork will be provided. The locking device comprises a screw which is tilted such that said screw may be tightly screwed into a hole of a supporting element of a wall formwork.

The screw will be tilted if, in the properly secured state, it includes an angle lower than 90° with the wall of the supporting element onto which the locking device has been mounted. Preferably the angle is 50° to 85°, especially preferred 70° to 80°, in order to be able to tightly secure the screw into a simple hole in a sheet metal wall, which especially may have different wall thicknesses.

Basically the locking device comprises a bottom side which least is planar in certain areas and especially is provided by a calotte plate which in the mounted state is flatly adjacent to the wall formwork or to a supporting element of the wall formwork, respectively. The screw then, with this plane, includes an angle lower than 90°, especially an angle between 40° and 85°.

A supporting element of a wall formwork basically consists of a metal hollow profile, especially a profile having a rectangular cross section, a square cross section or a hat-shaped cross section. Walls having such a profile are provided with one or more anchor rod bore holes for passing an anchor rod, which as well pass through the facing of wall formwork. Due to tilting the screw it will be sufficient to provide another hole or another bore hole, respectively, adjacent to an anchor rod bore hole on the backside wall of the respective supporting element, in order to be able to mount the locking device. Consequently, it will not be required to provide a supporting element with a thread into which the screw may be inserted and thus may tightly be screwed on. A hole in the sense of the invention therefore does not comprise a thread. In this way expenditures for manufacturing wall formworks will be reduced.

Adjacent to the anchor rod bore hole means that this additional non-threaded hole is arranged close to an anchor rod bore hole such that a screw of a conventionally dimensioned locking device may be screwed into this additional hole in order to be able to properly mount the locking device to the back side of a wall formwork. Hence, this additional hole generally is spaced apart from the anchor rod bore hole not more than 15 cm (measured from center to center of the holes), preferably not more than 10 cm, most preferably not more than 7 cm.

The mounting device enables an anchor system to absorb both tensile forces and compressive forces of a wall formwork. If a locking device will be mounted to the back side of a wall formwork, for example the back side of a first formwork, an anchor rod subsequently may first be passed through the closing formwork, followed by the first formwork which is opposite, in order to subsequently be connected, for example be screwed, to the locking device which is mounted to the back side of the first formwork. For this, advantageously solely one person will be sufficient, since the locking device has already been mounted onto the back side of the first formwork and consequently there is no need for a second person to secure it.

It is preferred that the locking device will be mounted to a supporting element which in the erected state extends vertically since such an element is basically configured with maximum stability and hence may sustain excessive loads.

It is preferred that the locking device will be mounted to the back side of a first formwork, since rapid installation will be maximized. After erection of the closing formwork has been completed a technician will be in the vicinity of the closing formwork in order to be able to immediately deploy the anchor rods.

In one embodiment of the invention the locking device comprises a guide bushing which is passed by the screw. The guide bushing is to guide and hold the screw. The guide bushing especially extends obliquely towards a planar bottom side of the locking device, at most basically parallel to the longitudinal extension of the screw.

In one embodiment of the invention the screw is in fact rotatably supported but may not be pulled out of the locking device. There are one or more retention means which prevent the locking device from being pulled out. The screw thus is advantageously securely connected to the locking device.

In one embodiment the screw comprises a handle for allowing manually rotating the screw without tools for mounting the locking device to a wall formwork. Advantageously the extension of the handle is such that it may not be inserted into a guide bushing for the screw. Thus securely connecting the screw to the locking device will be promoted.

In one embodiment the locking device comprises a bolt which protrudes opposite of a bottom side of the locking device such that it may protrude into an opening which is provided in the wall formwork. By way of this bolt cooperating with the screw the locking device which is attached to wall formwork will advantageously be prevented from being able to be twisted. Even if the thread of the screw in the attached state of the locking device will only contact one side of the associated bore hole or opening, respectively, the locking device may furthermore not be displaced. Especially, this embodiment enables attaching the locking device without the need to be confined to particular wall thickness. The locking device thus may advantageously be attached to wall formworks having different wall thicknesses, i.e. independent of a specified wall thickness. Basically for this it is solely required that said openings or bore holes are present.

In an embodiment the locking device comprises a calotte plate to which the thread is movably mounted, and is at most mounted similar to a joy stick. In this way it will be avoided that an anchor rod may no longer be properly connected to a thread of a locking device if two designated openings of two adjacent wall formworks are not aligned to each other. By using the locking device in a concrete wall formwork wherein the formwork elements, and consequently the anchor through hole bores in the formwork facings, are not directly aligned in a way facing each other, compressive forces acting upon the screw nut elements will radially be dissipated completely circumferentially in an extensive way from the cap surface to the screw nut elements despite the anchor rods not being perpendicular to the formwork facing surfaces. In this way a stable design of the concrete wall formwork will be assured. Furthermore possible damages of an anchoring system by local overload will be avoided.

In one embodiment of the invention the thread is mounted to the calotte plate in a torque-proof manner. By way of this embodiment it will be accomplished that an inserted end of an anchor rod may be screwed into the thread without preventing the thread from undesirably being entrained.

In one embodiment of the invention the calotte plate comprises the mounting device in order to be able to mount the calotte plate and thereby also the locking device to a wall formwork. It thereby will be accomplished that the calotte plate may be positioned at an appropriate position on the exterior of a wall formwork properly and sustainably in order allow screwing in the inserted end of an anchor rod into the thread of the locking device.

In one embodiment of the invention the mounting device simultaneously is part of a torsion protection in order to mount the thread on the calotte plate in a torsion-proof manner. Hence the mounting device adopts an additional function, thus simplifying the design of the locking device.

A wall formwork to which the locking device may be attached hence comprises at least an anchor rod bore hole passing through the wall formwork in order to be able to insert an anchor rod through the wall formwork. For the sake of stability the anchor rod bore hole will not only pass through the formwork facing of a wall formwork but also will pass through a supporting element. At least one hole in the wall of the associated supporting element is located on the back side of the supporting element adjacent to this anchor rod through hole, in order to be able to insert the screw into this hole for mounting the locking device. It is preferred that there is a second hole adjacent to the anchor rod bore hole for the accommodation of said bolt of the locking device.

Since the anchor rod may be exposed to relatively high forces, the anchor rod diameter basically is higher than the diameter of the threads of the screw as well der diameter of the bolt. Hence the diameter of the anchor rod bore hole passing through basically is higher than the diameter of the one or more adjacent openings on the back side of the respective supporting element, which are provided for the screw or the bolt of the locking device.

In order to be able to assure very reliable mounting the anchor rod through hole is located between the two openings which are provided for the screw and the bolt, as seen from the back side of a wall formwork. In order not to advantageously be required to take into consideration a specific alignment the distances between each of the openings and the anchor rod bore hole are equally seized. The diameters of the two openings also are equally seized in order to be able to connect the screw to both openings as well as to insert the bolt into both openings.

In order to be able to reliably and easily insert an anchor rod through the wall formworks each of the anchor rod bore holes advantageously tapers towards the back side of a wall formwork, i.e. towards the supporting elements. This on the one hand facilitates inserting through even if anchor rod bore holes of the first and closing formworks will not exactly be aligned. An anchor rod already inserted through a wall formwork may, due to the funnel-like shape, then be threaded more easily into the anchor rod bore hole of the opposite wall formwork and may be guided to the locking device which is attached to the back side.

A further advantageous configuration of the locking device comprises an stop which is removable from its stop position for an anchor rod end which is inserted into the thread in order to be able to optimize the effective length of an anchor rod.

In order to accomplish the object a system comprises the locking device according to the invention as well as the wall formwork according to the invention. Moreover the system may be configured analogously to the locking device and/or to the wall formwork according to the invention.

In the following an advantageous embodiment of the invention will be explained in more detail by way of figures.

In FIG. 1 a sectional view of a locking device is shown which comprises a calotte plate 1 and a bushing 2 which is movably connected to the calotte plate 1. The bushing 2 is provided with an internal thread 3 into which the external thread of an anchor rod end shown in FIG. 2 is inserted. This anchor rod end is provided with a tip 5, in order to be able to easily thread the end into the internal thread 3 of the locking device. At one end the bushing 2 is provided with an outer circumferential groove 6 which is provided by flanges 7 and 8 which radially protrude from the bushing 2. The flanges 7 and 8 show an arcuate section such that the bushing 2 may be displaced like a joy stick in relation to the calotte plate 1. A rim area 9 of the opening of the calotte plate 1 protrudes into this groove 6, having an allowance such that the bushing 2 remains free in relation to the calotte plate 1. Especially for this reason the rim area 9 is spaced apart from the outer circumference of the bushing 2.

A screw 10 passes through the calotte plate 1 and is guided by the guide bushing 11 which is mounted to the calotte plate 1. The guide extends obliquely towards the planar bottom side of the calotte plate 1 which in the mounted state is flatly adjacent to the back side of a supporting element of the wall formwork. The screw 10 thus will include an angle lower than 90°.

The end having the thread of the screw 10 protrudes opposite of the bottom side of the calotte plate 1 such that the end provided with the thread of the screw 10 may be screwed into an opening of a supporting element of a wall formwork in order to be able to mount the calotte plate 1 to the back side of this wall formwork. The bottom side of the calotte plate 1 comprises a bolt 12 protruding from the bottom side which protrudes into a designated opening in the supporting element of the wall formwork in order to be able to mount the calotte plate to the back side of a wall formwork in a torque-proof manner and independent of a specified wall thickness. The bottom side of the calotte plate then is adjacent to the back side of a wall formwork, at most such that the thread 3 is aligned with the anchor rod bore hole passing through the wall formwork. The screw 10 is rotatably supported by the bushing 11, but is preferably secured against falling out of the bushing 11 such as for example by a circumferential groove 13, into which for example a tongue protrudes which is connected to the bushing 11.

The screw 10 is provided with an oval handle 14, in order to be able to manually mount the screw 10 to a wall formwork. The oval handle 14 extends transversally to the longitudinal extension of the screw 10 beyond the rim of the guide bushing 11 and consequently prevents the screw from being inserted into guide bushing 11 from the side of the handle.

The bushing 2 having the internal thread 3 is passed by a cylindrical stop 15 at the end adjacent to the calotte plate 1. The stop 15 extends transversally to the longitudinal extension of the bushing 2, i.e. passing a transversal bore hole of the bushing 2 which functions as a support for the stop 15. The stop 15 may be twisted but may not be pulled out of the bushing 2. This will be prevented by the radially protruding tongue 16 at one end and will be prevented at the other end by a locking ring 17. The stop 15 comprises a transversal bore hole 18 which is dimensioned and may be aligned by way of rotating the stop 6 such that an end which is screwed into the thread 3 of the bushing 2 of an anchor rod may pass through the hole 18. The hole 18 then is aligned with the thread 3. In this aligned position the stop 15 has been removed from its stop position.

In FIG. 1 there is shown an stop position of the stop 15. If one end of an anchor rod is screwed into the thread 3 of the bushing 2 the tip 5 of the anchor rod end finally will contact the stop 6, such that the anchor rod may not be screwed any further into the thread 3. In order to allow further insertion the stop 15 shown in FIG. 1 initially must be twisted by 90°.

In order to be able to smoothly twist the stop 15 it has a handle 19. The handle 19 is similar to the handle 14. However, in comparison to handle 14 the handle 19 is shown twisted by 90°. Shown in top view the oval handle 19 thus has a longitudinal extension which corresponds to the extension of the transversal bore hole 18 thus signalizing the extension of this transversal bore hole 18.

From the bushing 2 a yoke which is attached thereto protrudes towards guide bushing 11 and encloses the latter with its two ends on two sides thus being able to prevent undesired twisting of the thread 3. The yoke 27 together with the guide bushing 11 thus forms the torsion protection for the thread 3.

The anchor rod shown in FIG. 2 has a central area 20 having a smooth surface, the central area tapering towards the tip 5. The other end of the anchor rod in turn is provided with a thread 21.

Figure 3:
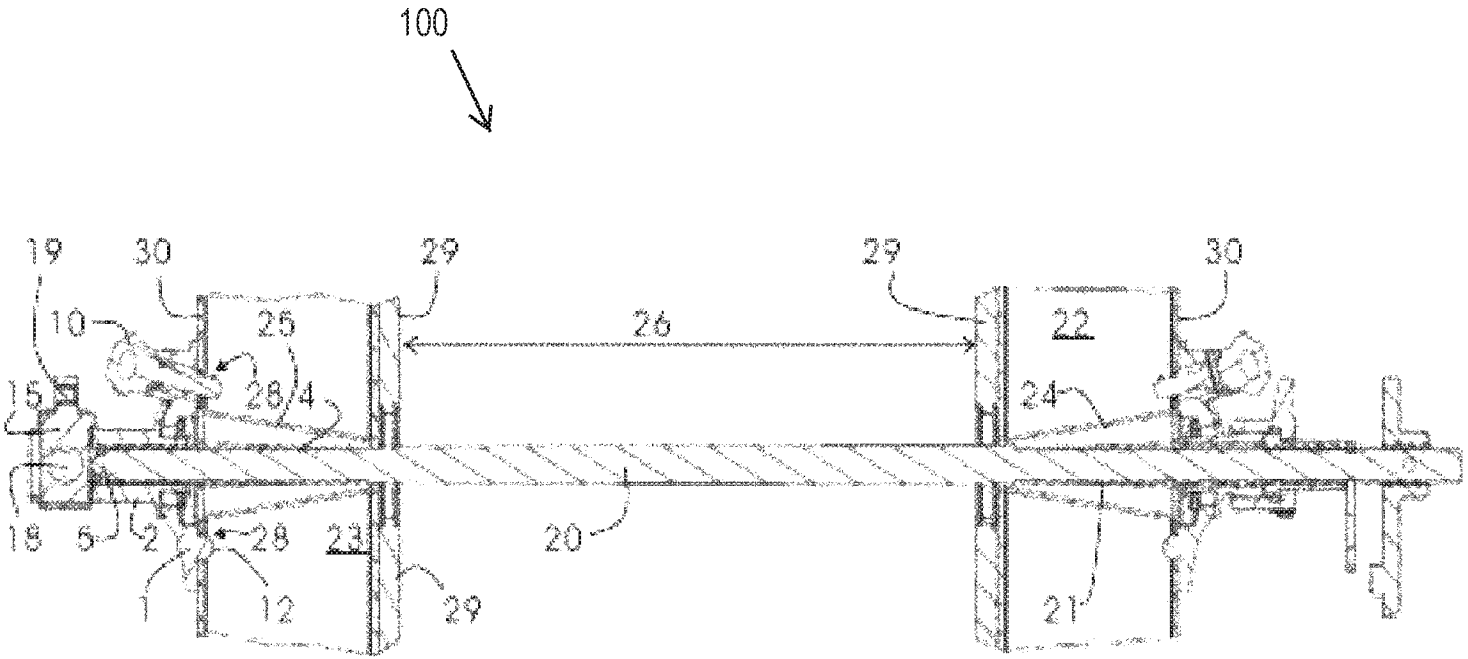
FIG. 3 is a sectional view of two adjacent wall formworks.

In FIG. 3 a sectional view of an anchoring system 100 is shown. The anchoring system 100 comprises two adjacent wall formworks 22 and 23, which are erected for the manufacture of a concrete wall. At the back side of the wall formwork 23 a locking device as shown in FIG. 1 is mounted by way of screw 10 and bolt 12 in a torque-proof manner. The screw 10 is twisted into an opening 28. An opening 28 is arranged above and below of each of the anchor rod bore holes 24 and 25 within the sheet metal back wall 30 of a supporting element for each one of the formwork facings 29. Starting from the back side of the wall formwork 22 the anchor rod has been inserted through the anchor rod bore holes 24 and 25 of both back side formworks 22 and 23 and then has been screwed into the thread 3 of the bushing 2 until the tip 5 of the anchor rod is in contact with the stop 15, as it is depicted. In order to facilitate it the anchor rod bore holes 24 and 25 expand towards the supporting profile or the supporting element 30, respectively, in a funnel-shaped manner.

Since the tip 5 of the anchor rod has been brought into contact with the stop 15 the thread 4 of the anchor rod is located exterior of the area between the two wall formworks 22 and 23, which is filled with concrete. Also the other end having the thread 21 is located exterior of the area to be cast with concrete. Between the two front sides or formwork facings 29, respectively, of the two wall formworks 22 and 23 there is a distance 26, which defines the thickness of the wall to be produced.

Finally another locking device is suitably screwed onto the thread 21 of the anchor rod as well as will be connected to the back side of the wall formwork 22 in order to be able to absorb force. Advantageously said other locking device is also connected to the back side of the wall formwork 22, for example with the help of a screw 10 in order to thus be able to absorb both tensile forces and compressive forces.

The maximum width of the wall to be produced will then be accomplished if both ends of the central area 20 are adjacent to the front sides of both wall formworks 22 and 23 such that both threads 3 and 21 of the anchor rod do not protrude into the area between the two wall formworks. The minimal width of a wall to be produced will be accomplished if both locking devices have maximally been screwed onto both thread ends 4 and 21, the stop 15 then being distant from its stop position.

No threads are required in order to fasten the screw 10 in an opening 28. A simple hole 28 in a sheet metal wall of a supporting element which advantageously may at the same time serve for accommodation and retention of a bolt 12, as it is depicted in FIG. 3.

Figure 4:
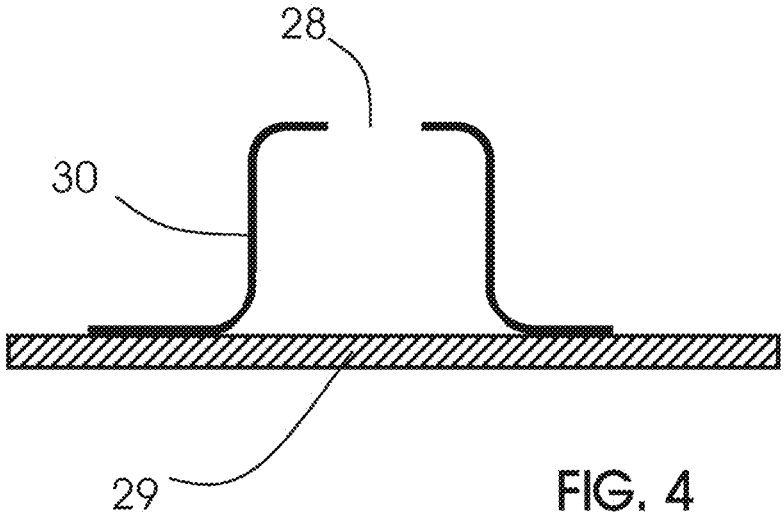
FIG. 4 is a sectional view of a hat profile of a supporting element and a backside bore hole that is attached to a formwork facing.

In FIG. 4 a sectional view of the hat profile of a supporting element 30 along with a backside bore hole 28 or opening, respectively, is shown which is attached to a formwork facing 29.

Figure 5:
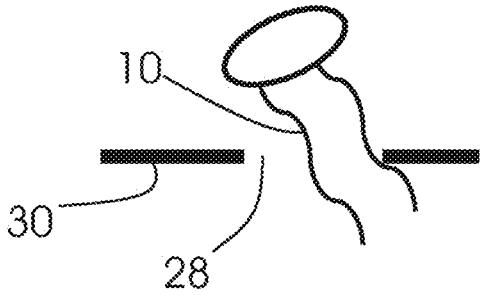
FIG. 5 is a sectional view of a thread of a screw that is secured in a bore hole.

In FIG. 5 a sectional view of the thread of a screw 10 which is secured in the bore hole 28 is outlined. The distance between two thread pitches of the screw 10 is higher than the strength of the sheet metal from which the supporting element 30 is made. FIG. 5 illustrates that the strength of the sheet metal may vary without the need of modifying the distance between two thread pitches of the screw 10. The thread of the screw 10 solely is in contact with one side of the bore hole 28.

The invention claimed is:

1. A system having:

a wall formwork, the wall formwork comprising:

a first formwork facing and a second formwork facing;

a first supporting profile for the first formwork facing and a second supporting profile for the second formwork facing;

a first anchor rod bore hole passing through the first formwork facing and the first supporting profile and a second anchor rod bore hole passing through the second formwork facing and the second supporting profile; and a first non-threaded hole and a second non-threaded hole formed through the first supporting profile and disposed adjacent to the first anchor rod bore hole;

an anchor system comprising a first locking device, wherein the first locking device comprises a first bore for mounting the first locking device to a first end of an anchor rod that passes through the first formwork facing;

a first mounting device for mounting the first locking device to the first supporting profile, the first mounting device comprising a first screw and a first bolt, wherein, when the first mounting device is secured to the wall formwork, the first screw is secured in the first non-threaded hole and is tilted to make an angle of less than 90° with the first formwork facing and the first bolt extends into the second non-threaded hole;

wherein the first non-threaded hole and the second non-threaded hole not more than 15 cm from the first anchor rod bore hole; and wherein a distance between two thread pitches of the first screw is greater than a thickness of a wall to which the first locking device attaches.

2. The system of claim 1, wherein:

the first screw is tilted such that the first screw may be secured in the first non-threaded hole and the first screw forms an angle between 40° and 85° relative to a planar bottom side of the first locking device.

3. The system of claim 2, wherein the first locking device comprises a first guide bushing for the first screw, wherein the first guide bushing forms an angle between 40° and 85° with the planar bottom side of the first locking device.

4. The system of claim 2, wherein the first screw is rotatably and securely arranged in a first guide bushing.

5. The system of claim 2, characterized in that wherein the first screw comprises a handle to assist with insertion of the first screw into the first non-threaded hole.

6. The system of claim 1, wherein the first anchor rod bore hole is located between the first and second non-threaded holes.

7. The system of claim 1, wherein the first anchor rod bore hole expands towards the first supporting profile.

8. The system of claim 7, wherein a diameter of each of the non-threaded holes is less than a smallest diameter of the first anchor rod bore hole.

9. The system of claim 1, wherein:

the wall formwork further comprises a third non-threaded hole and a fourth non-threaded hole formed through the second supporting profile and disposed adjacent to the second anchor rod bore hole;

the an anchor system further comprises a second locking device comprising a second bore for mounting the second locking device to a second end of the anchor rod that passes through the second formwork facing;

the system further comprises a second mounting device for mounting the second locking device to the second supporting profile, the second mounting device comprising a second screw and a second bolt, wherein, when the second mounting device is secured to the wall formwork, the second screw is secured in the third non-threaded hole and is tilted to make an angle of less than 90° with the second formwork facing and the first bolt extends into the fourth non-threaded hole;

wherein the third non-threaded hole and the fourth non-threaded hole are arranged not more than 15 cm from the second anchor rod bore hole; and wherein a distance between two thread pitches of the second screw is greater than a thickness of a wall to which the second locking device attaches.

10. The system of claim 9, wherein the second screw is tilted such that the second screw may be secured in the third non-threaded hole and the second screw includes an angle between 40° and 85° relative to a planar bottom side of the second locking device.

11. The system of claim 10, wherein the second locking device comprises a second guide bushing for the second screw, wherein the second guide bushing forms an angle between 40° and 85° with the planar bottom side of the second locking device.

12. The system of claim 10, wherein the first screw is rotatably and securely arranged in a first guide bushing and the second screw is rotatably and securely arranged in a second guide bushing.

13. The system of claim 9, wherein the first and second screws each comprise a handle to assist with insertion of the first and second screws into the first and third non-threaded holes, respectively.

14. The system of claim 9, wherein the second anchor rod bore hole is located between the third and fourth non-threaded holes.

15. The system of claim 9, wherein the second anchor rod bore hole expands towards the second supporting profile.

* * * * *